United States Patent [19]

Shimada et al.

[11] 4,210,469

[45] Jul. 1, 1980

[54] PROCESS OF ANNEALING FOR PREVENTING TEMPER COLORS ON A STEEL SHEET

[75] Inventors: Shoji Shimada; Kazuhiko Yoshinari; Hidefumi Koyakumaru, all of Kitakyushu, Japan

[73] Assignee: Nippon Steel Corp., Ote, Japan

[21] Appl. No.: 832,578

[22] Filed: Sep. 12, 1977

Related U.S. Application Data

[63] Continuation of Ser. No. 592,532, Jul. 2, 1975, abandoned.

[30] Foreign Application Priority Data

Jul. 11, 1974 [JP] Japan ..... 49-79425

[51] Int. Cl.[2] ..... C21D 1/48

[52] U.S. Cl. ..... 148/16; 148/20.3; 148/121

[58] Field of Search ..... 148/16, 12.1, 13.1, 148/20.3, 113, 121, 14, 12, 112; 266/255, 262, 263, 264, 266

[56] References Cited

U.S. PATENT DOCUMENTS

| | | | |
|---|---|---|---|
| 652,980 | 7/1900 | Perin | 148/14 |
| 2,709,145 | 5/1955 | Bucknall | 148/13.1 |
| 2,992,952 | 7/1961 | Assmus et al. | 148/111 |
| 3,053,523 | 9/1962 | Shipley | 266/251 |
| 3,229,967 | 1/1966 | Engelhard | 266/255 |
| 3,290,030 | 12/1966 | Goehring | 266/257 |
| 3,294,596 | 12/1966 | Daubersy | 148/16 |
| 3,834,952 | 9/1974 | Matsushita et al. | 148/112 |

*Primary Examiner*—L. Dewayne Rutledge
*Assistant Examiner*—John P. Sheehan
*Attorney, Agent, or Firm*—Wenderoth, Lind & Ponack

[57] ABSTRACT

A process of annealing for preventing temper colors on a steel sheet in a box annealing furnace, which comprises placing an oxidizable iron-base material at a position of low temperature in a circulating path of a furnace gas.

2 Claims, 2 Drawing Figures

PROCESS OF ANNEALING FOR PREVENTING TEMPER COLORS ON A STEEL SHEET

This is a continuation of application Ser. No. 592,532, filed July 2, 1975 now abandoned.

BACKGROUND OF THE INVENTION

FIELD OF THE INVENTION

The present invention relates to a bright annealing process in a box annealing furnace for preventing temper colors which are produced on the outermost layer of a cold rolled steel sheet during its annealing.

In the bright annealing, the annealing is done without oxidation of the cold rolled steel sheet so as to maintain its surface brightness, and for this purpose, it is necessary to enclose the cold rolled steel sheet in a furnace atmosphere of such as DX, NX and HNX all through the process including the heating step and the cooling step.

However, the furnace atmosphere of such as DX and NX etc. varies in its equilibrium composition depending on the gas concentration and produces temper colors on a cold steel sheet which is heated and cooled in the atmosphere, thus damaging a considerable portion of the cold rolled steel sheet surface. Not only the temper colors damage the surface appearance of the sheet, but the surface on which the temper colors are produced gives only a rougher surface even after acid-pickling as compared with the surface which is not affected by the temper color and when it is subjected to a phosphate treatment it gives surface irregularlities due to its difference in reactivity from that of the surface which is not affected by the temper color.

Particularly, a high strength cold rolled steel sheet (Si-Mn-Cr steel), a low-grade silicon steel (ZNC-3), and a Riband steel which have been developed with the advent of safety automobiles in recent years have far much larger susceptibility to the temper colors as compared with an ordinary low carbon steel (SPC steel).

Thus, a steel sheet containing a large amount of Si and Mn has large susceptibility to the temper colors during the annealing because Si and Mn themselves are far more easily oxidized than Fe, and temper colors which are produced at a relatively high temperature between 650° and 750° C. are oxides of Mn and Si such as $MnSi0_3$, which are oxidized under the presence of a small amount of water vapor and become milky white. Further, in a cooling furnace with the same dew point of −60° C., the steel sheet containing a large amount of Mn and Si has a higher temperature range in which the temper color takes place as compared with the ordinary carbon steel sheet, and the temper colors thus produced are brown.

The present inventors have conducted extensive studies to find technical means for minimizing the thickness of the oxide film which causes the temper colors on an assumption that it would be possible to reduce the oxide film thickness to a thickness of no visual problem, although it would be impossible to prevent completely the oxidation of Mn and Si, and have found that the visual oxides, namely the temper colors, which are produced when the cold rolled steel sheet of an ordinary composition or containing Si, Mn and Cr, etc. is annealed under the presence of dew or $H_2O$ can be prevented by placing an oxidizable material in the annealing process, particularly in a lower temperature zone in the cooling step.

The feature of the present invention lies in that an oxidizable material is placed at a position of a low temperature zone in a circulating path of a furnace gas in a box annealing furnace.

DESCRIPTION OF THE PREFERRED EMBODIMENT

The present invention will be described with reference to the attached drawings.

Figure 1:
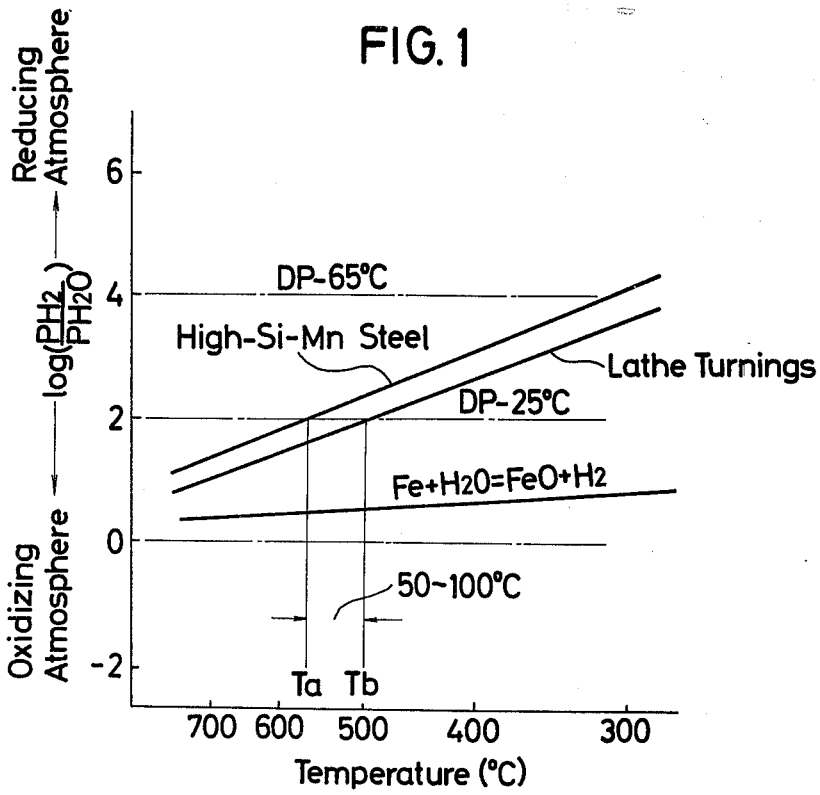
FIG. 1 shows the oxidation-reduction equilibrium between the steel sheet and $H_2O$.

As understood from FIG. 1, in case of a high-Mn-Si steel material, which has been annealed in a gas mixture with a dew point of −25° C., for example, the oxidation is caused at the temperature Ta during the cooling step and the temper colors are caused. In order to prevent the temper colors, it is necessary to maintain a dew point of lower than −60° C.

However, when the annealing is done with the oxidizable material such as lathe turnings provided on the inside wall of the annealing furnace, the oxidizable material reaches the temperature Tb before the steel sheet reaches the temperature Ta during the cooling step so that the oxidizable material can absorb and eliminate $H_2O$ contained in the furnace atmosphere just before the oxidation of the steel sheet, thus preventing the temper colors from occurring on the steel sheet.

The present invention is based on the above discovery and one of the objects of the present invention is to provide a process for bright annealing in a box type furnace.

Figure 2:
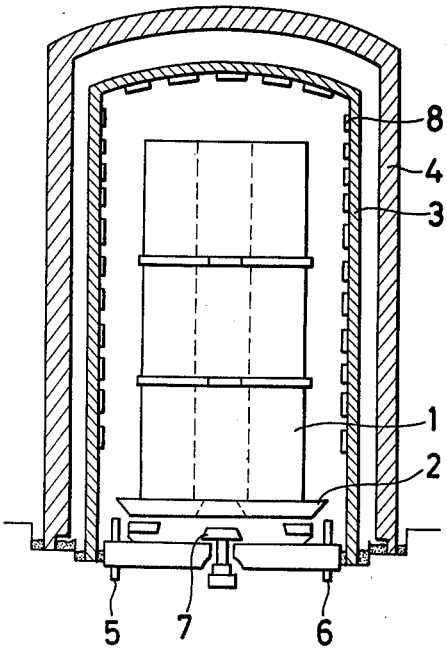
FIG. 2 is a cross sectional view of an embodiment of the present invention.

In FIG. 2, 1 represents a cold rolled steel sheet to be annealed in the form of a coil or a cut sheet. The cold rolled steel sheet is of an ordinary steel composition with or without a small amount of Si, Mn, Cr, etc. and has been hot rolled and cold rolled. 2 is a carrier for the cold rolled steel sheets, 3 is an inner cover which covers spacedly the cold rolled sheets. Inside the outer cover 4, a heating member such as a gas burner, a radient tube and an electric heating wire is provided so as to heat the cold rolled steel sheet through the inner cover 3. 5 and 6 are respectively a supply opening and an exhaust opening, both provided on the furnace bottom for the furnace gas, 7 is a fan provided on the furnace bottom for circulating the supplied furnace gas. These members constitute the box annealing furnace.

8 is an oxidizable material, which is arranged at a place which is at a temperature lower (preferably 50° to 100° C.) than the temperature retained by the cold rolled steel sheet after heating near the inside of the inner cover 3 or near the furnace bottom. As for the oxidizable material 8, a low cost iron-base material which is easily oxidized at low temperatures, and has a high melting point, such as lathe turnings of cast iron and steel scraps may be used, or steel fins may be provided on the inner cover 3.

Now, when the annealing of the cold rolled steel sheet 1 is done in the box annealing furnace while supplying and circulating the furnace gas within the inner cover 3, with a part thereof being exhausted from the exhaust opening 5 or 6, the cold rolled steel sheet 1 is oxidized together with the oxidizable iron-base material 8 during the heating step, but is reduced while it is maintained at high temperatures without causing any problem, and during the cooling step, the oxidizing reaction of the furnace gas due to the temperature change oxidizes only the oxidizable material positively, so that the furnace gas can maintain a reducing atmosphere to the cold rolled steel sheet, and thus the temper color can be prevented.

According to the present invention, as no temper color is produced on the cold rolled steel sheet, not only a beautiful appearance of the cold rolled steel sheet can be assured, but also surface treatments such as a phosphate treatment can be performed without a problem of irregular surface appearance.

An example of the present invention will be described hereinunder.

EXAMPLE

A coil of cold rolled steel strip containing 0.08% C, 0.05% Si, 0.3% Mn and 0.05% Cr was annealed in a furnace atmosphere ($N_2$: 95%, $H_2$: 5%, dew point: −50° C.) at 700° C. within an inner cover provided with steel scrap on its inside wall, covered further with an outer cover.

For comparison, a similar annealing was done without the steel scrap. The results revealed that no temper color was observed on the sheet annealed according to the present invention, but temper colors of 50 to 100 mm width were observed on edge portions of the coil annealed without the steel scrap.

As understood from the above, the temper color can be eliminated or reduced to a negligible degree of no practical problem when a high-Si or a high-Mn steel sheet such as a high strength steel sheet, a low-grade electrical steel sheet and Riband steels is annealed by the present invention, and thus a high degree of production yield, and a high degree of efficiency in subsequent surface treatment can be obtained.

What is claimed is:

1. In a method for box annealing a cold rolled steel strip coil at a temperature of 650° to 750° C. in a furnace in which a protective furnace gas containing small amounts of water vapor therein is circulated, said cold rolled steel strip coil being susceptible to the development of temper colors on the surface thereof during the box annealing at said temperature range, and then cooling the thus-annealed steel strip coil, the improvement wherein an iron-base material capable of being oxidized at low temperatures is placed within the circulating path of the furnace gas in the furnace at a position inside an inner cover of the furnace and above the furnace bottom, where the iron-base material is at a temperature which is between 50 and 100° C. lower than that of the steel strip coil in the cooling step of the annealing cycle so as to ensure that the iron-base material first reacts with the water vapor during the cooling step to produce a reducing furnace atmosphere, thereby preventing the formation of temper colors on the steel strip, said iron-base material being one selected from the group consisting of lathe turnings of cast iron and steel scraps.

2. A method according to claim 1, wherein the steel strip consists essentially of 0.08% C, 0.05% Si, 0.3% Mn, 0.05% Cr and the remainder Fe; the annealing takes place at a temperature of 700° C. and the furnace atmosphere is a mixture of 95% $N_2$ and 5% $H_2$ gas having a dew point of −50° C.

* * * * *